US007174642B2

(12) United States Patent
Diggle, III et al.

(10) Patent No.: US 7,174,642 B2
(45) Date of Patent: Feb. 13, 2007

(54) CUTTING GUIDE

(75) Inventors: Frederick James Diggle, III, Birmingham, AL (US); Paul Brent Rivers, Cullman, AL (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 108 days.

(21) Appl. No.: 10/728,143

(22) Filed: Dec. 4, 2003

(65) Prior Publication Data

US 2005/0120851 A1 Jun. 9, 2005

(51) Int. Cl.
*B26B 29/00* (2006.01)

(52) U.S. Cl. ..... 30/372; 30/92

(58) Field of Classification Search ..... 30/92, 30/514, 517, 371, 372, 293; 83/743, 745, 83/761; 33/42, 755, 759, 770
See application file for complete search history.

(56) References Cited

U.S. PATENT DOCUMENTS 1,395,957 A * 11/1921 Griffin ..... 24/457
6,154,963 A * 12/2000 Kooiman ..... 30/90.2
6,944,961 B2 * 9/2005 Carroll ..... 33/42

OTHER PUBLICATIONS

U.S. Appl. No. 10/718,460, filed Nov. 20, 2003.
U.S. Appl. No. 10/695,573, filed Oct. 28, 2003.

* cited by examiner

*Primary Examiner*—Kenneth E. Peterson
*Assistant Examiner*—Phong Nguyen
(74) *Attorney, Agent, or Firm*—Lee & Hayes, PLLC

(57) ABSTRACT

A cutting guide. The cutting guide includes a body portion having a leading edge and an opening therethrough and an engagement portion concentrically attached to the body portion. The leading edge is adapted to guide a saw while a cut is being made in a material.

7 Claims, 5 Drawing Sheets

CUTTING GUIDE

BACKGROUND

The present invention is directed generally and in various embodiments to a cutting guide.

Personnel often use a saw such as, for example, a hacksaw or a crosscut saw to cut, for example, pipe or conduit to a desired length. However, the blade of the saw can easily drift laterally from the desired cut location. If the cut is not sufficiently precise, the resulting length of pipe or conduit can be longer or shorter than the length that is needed. Inaccurate cuts lead to increased material costs and decreased productivity.

To reduce the chance of the blade drifting during the cut, many personnel tend to work at a much more deliberate pace while cutting. However, this approach increases the amount of time spent starting a cut, thereby contributing to decreased productivity.

SUMMARY

In one embodiment, the present invention is directed to a cutting guide. The cutting guide includes a body portion having a leading edge and an opening therethrough and an engagement portion concentrically attached to the body portion. The leading edge is adapted to guide a saw while a cut is being made in a material.

In one embodiment, the present invention is directed to a saw. The saw includes a blade and a handle attached to the blade, wherein the handle includes a cutting guide holder, the cutting guide holder including a plurality of raised portions adapted to engage a body portion of a cutting guide to securely retain the cutting guide on the handle.

Other systems, methods, and/or products according to embodiments will be or become apparent to one with skill in the art upon review of the following drawings and detailed description. It is intended that all such additional systems, methods, and/or products be included within this description, be within the scope of the present invention, and be protected by the accompanying claims.

BRIEF DESCRIPTION OF THE DRAWINGS

Further advantages of the present invention may be better understood by referring to the following description taken in conjunction with the accompanying drawings, in which:

FIG. 5 is a diagram illustrating a side view of a placement of a cutting guide during cutting according to one embodiment of the present invention;

DESCRIPTION

It is to be understood that the figures and descriptions of the present invention have been simplified to illustrate elements that are relevant for a clear understanding of the present invention, while eliminating, for purposes of clarity, other elements. Those of ordinary skill in the art will recognize, however, that these and other elements may be desirable. However, because such elements are well known in the art, and because they do not facilitate a better understanding of the present invention, a discussion of such elements is not provided herein.

Figure 1:
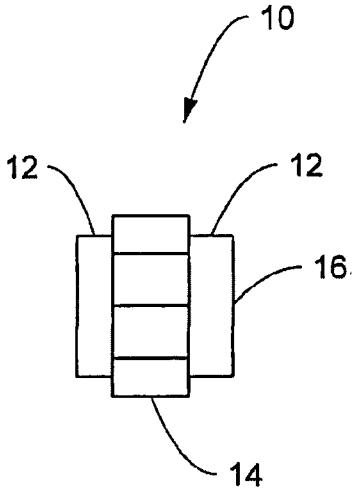
FIG. 1 is a diagram illustrating a side view of a cutting guide according to one embodiment of the present invention.

FIG. 1 is a diagram illustrating a side view of a cutting guide 10 according to one embodiment of the present invention. The guide 10 includes a body portion 12 and an engagement portion 14. The guide 10 is generally cylindrically shaped and includes an opening 16 therethrough such that a user can place a portion of the user's hand (e.g., a thumb) through the opening 16. The body portion 12 may be constructed of a durable material such as, for example, metal or plastic. In various embodiments in which the body portion 12 is constructed of metal, the metal may be a hardened metal. The engagement portion 14 is constructed of a non-slip, or tacky, material such as, for example, rubber or plastic.

Figure 2:
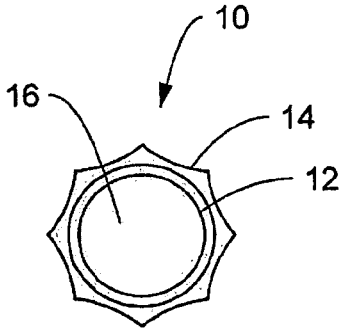
FIG. 2 is a diagram illustrating a front view of the cutting guide of FIG. 1 according to one embodiment of the present invention.
Figure 2A:
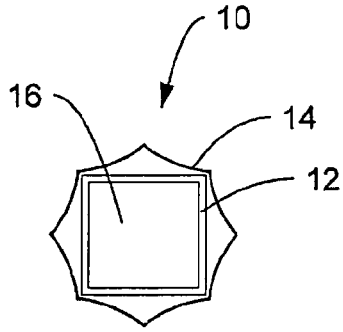
FIG. 2A is a diagram illustrating a front view of a cutting guide according to another embodiment of the present invention.

FIG. 2 is a diagram illustrating a front view of the cutting guide 10 of FIG. 1 according to one embodiment of the present invention. As can be seen in FIG. 2, the engagement portion 14 of the guide 10 is shaped such that when the engagement portion 14 is in contact with a cylindrically shaped material (e.g., pipe, conduit, etc.) that is being cut, the engagement portion 14 conforms to the shape of the material.

Figure 3:
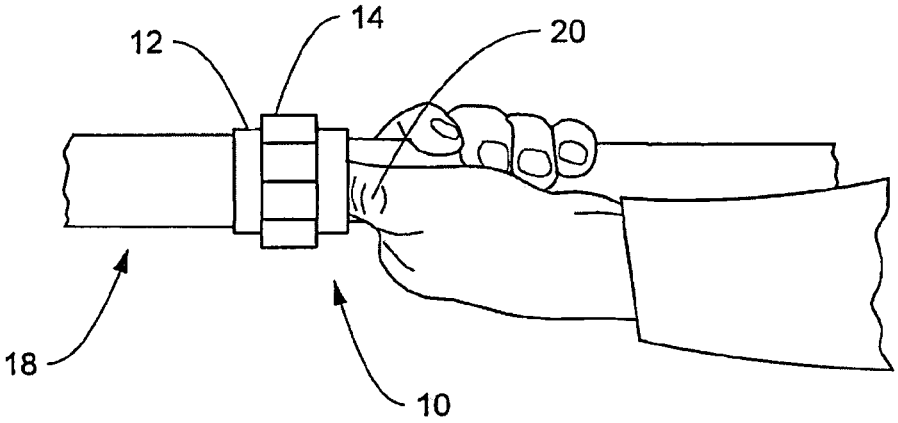
FIG. 3 is a diagram illustrating a placement of a cutting guide prior to the start of cutting according to one embodiment of the present invention.

FIG. 3 is a diagram illustrating a placement of a cutting guide 10 prior to the start of cutting according to one embodiment of the present invention. As can be seen in FIG. 3, the cutting guide 10 is placed on a material 18 (e.g., a pipe, conduit, etc.) that is to be cut such that the engagement portion engages the material 18. A portion 20 of a user's hand (e.g., a thumb) is inserted through the opening 16 of the guide 10 and pressure is placed, via the portion 20, on the guide 10 such that the engagement portion 14 (and thus the guide 10) is kept in contact with the material 18.

Figure 4:
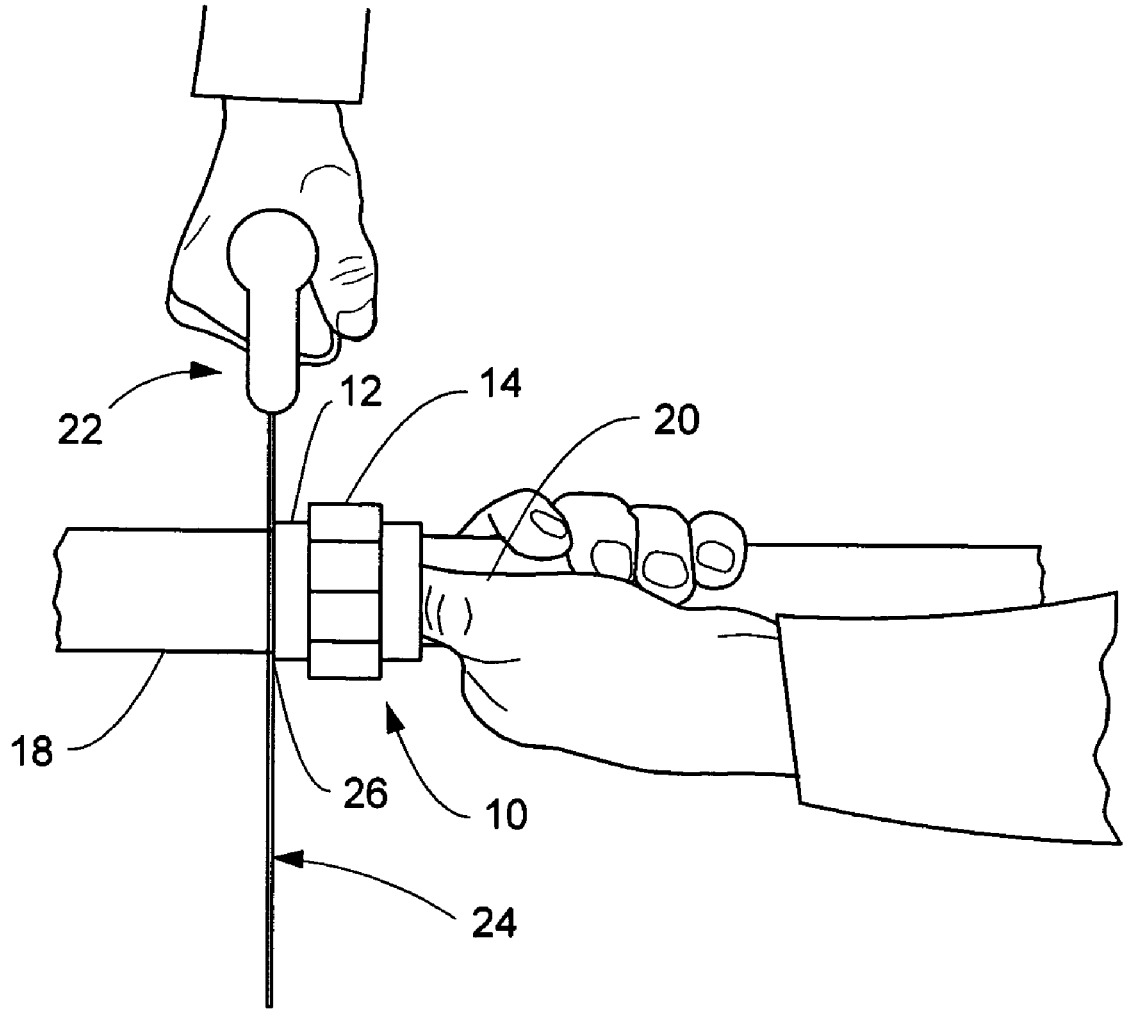
FIG. 4 is a diagram illustrating a top view of a placement of a cutting guide during cutting according to one embodiment of the present invention.

FIG. 4 is a diagram illustrating a top view of a placement of a cutting guide 10 during cutting according to one embodiment of the present invention. As can be seen in FIG. 4, a saw 22 is placed on the material 18 such that a blade 24 of the saw 22 engages a leading edge 26 of the body portion 12 of the guide 10. The user may then saw the material 18 and, by keeping the blade 24 of the saw 22 lined up with the leading edge 26 of the body portion 12 of the guide 10, may make a substantially straight cut all or part way through the material 18.

FIG. 5 is a diagram illustrating a side view of a placement of a cutting guide 10 during cutting according to one embodiment of the present invention.

Figure 6:
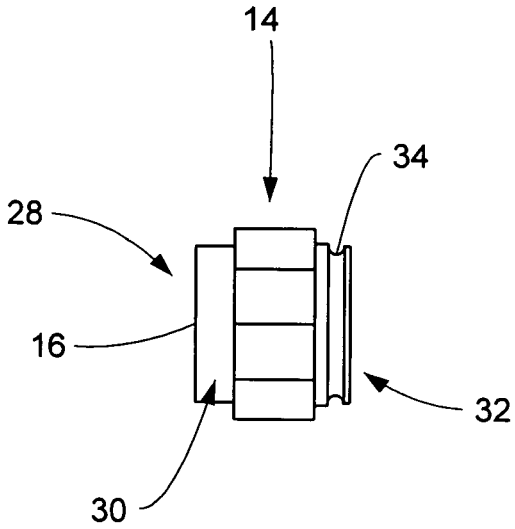
FIG. 6 is a diagram illustrating a side view of a cutting guide according to one embodiment of the present invention.

FIG. 6 is a diagram illustrating a side view of a cutting guide 28 according to one embodiment of the present invention. As can be seen in FIG. 6, the guide 28 includes a body portion 30 that has the opening 16 therethrough. A leading edge 32 of the body portion 30 includes a groove 34 that is sized to fit onto a cutting guide holder as described herein in conjunction with FIGS. 8–11. Although the groove 34 is illustrated in FIG. 6 as being on the leading edge 32, the groove 34 may be located on either edge of the body portion 30. The body portion 30 may be constructed of a durable material such as, for example, metal or plastic. In various embodiments in which the body portion 30 is constructed of metal, the metal may be a hardened metal.

Figure 7:
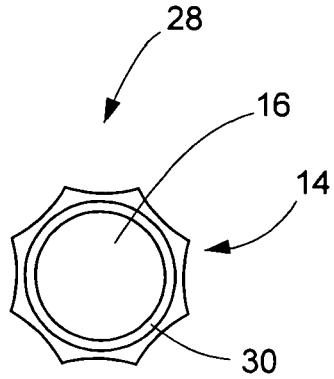
FIG. 7 is a diagram illustrating a front view of the cutting guide of FIG. 6 according to one embodiment of the present invention.

FIG. 7 is a diagram illustrating a front view of the cutting guide 28 of FIG. 6 according to one embodiment of the present invention. It can be understood that the cutting guide 28 may be used in operation similarly to the cutting guide 10 as described herein in conjunction with FIGS. 3–5.

Figure 8:
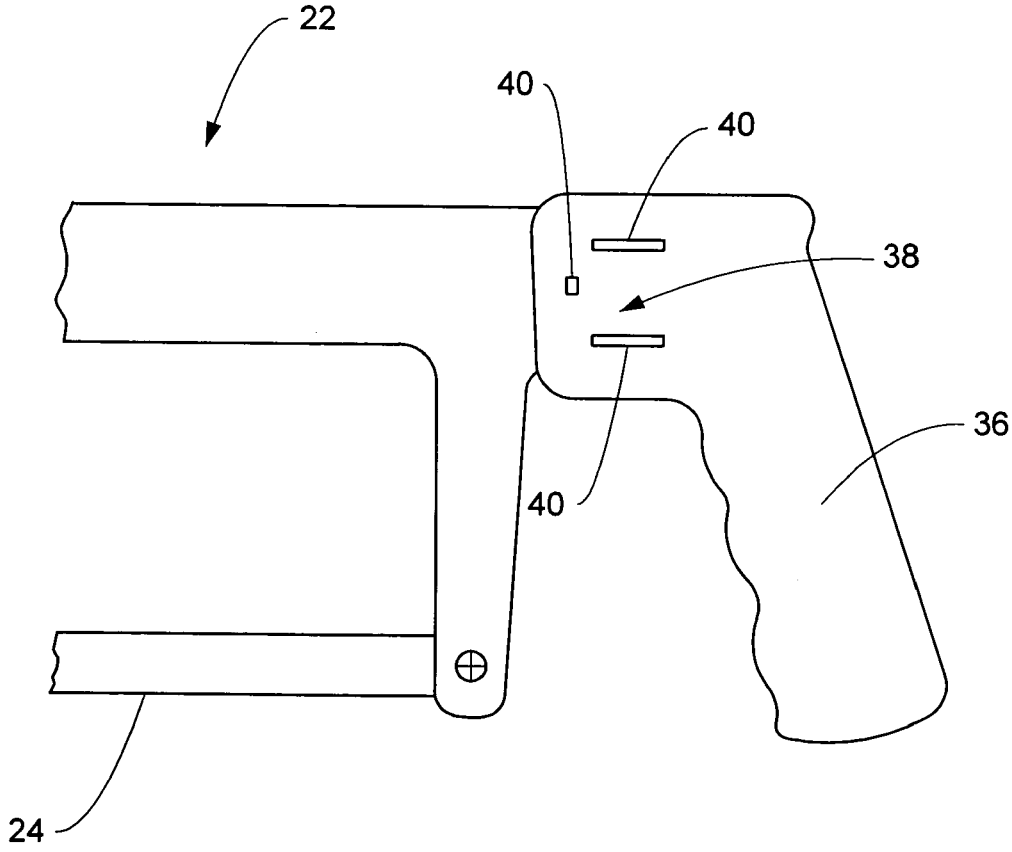
FIG. 8 is a diagram illustrating a side view of a portion of a saw having a cutting guide holder according to one embodiment of the present invention.

FIG. 8 is a diagram illustrating a side view of a portion of the saw 22 having a cutting guide holder 38 on a handle 36 of the saw 22 according to one embodiment of the present invention. The cutting guide holder 38 is comprised of flexible raised portions 40 that are either attached to or molded onto the handle 36 of the saw 22. The flexible raised portions 40 may be constructed of, for example, metal or plastic.

Figure 9:
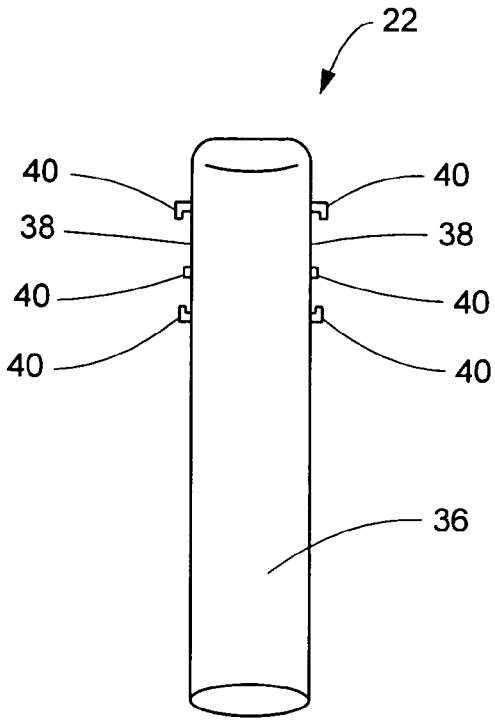
FIG. 9 is a diagram illustrating a rear view of the saw of FIG. 8 according to one embodiment of the present invention.

FIG. 9 is a diagram illustrating a rear view of the saw 22 of FIG. 8 according to one embodiment of the present invention. As can be seen in FIG. 9, the handle 36 of the saw 22 includes a cutting guide holder 38 on each side of the handle 36. The flexible raised portions 40 of each cutting guide holder 38 are shaped such that they may engage the groove 34 of the leading edge 32 of the body portion 30 of the cutting guide 28 such that the cutting guide 28 is retained on the handle 36 during periods of non-use of the cutting guide 28.

Figure 10:
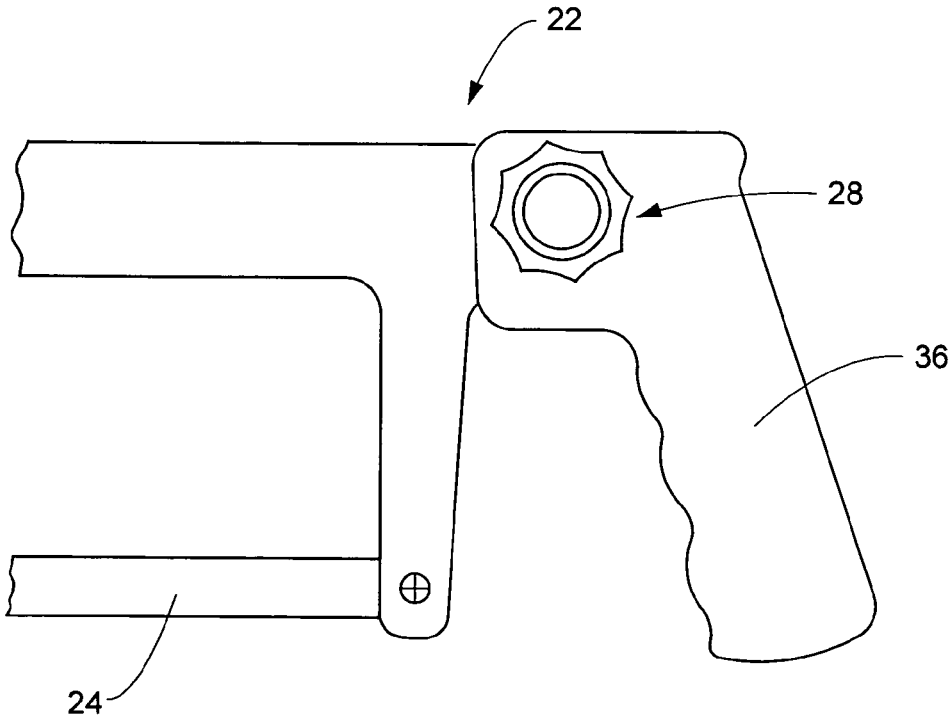
FIG. 10 is a diagram illustrating a side view of a portion of a saw having a cutting guide attached according to one embodiment of the present invention.

FIG. 10 is a diagram illustrating a side view of a portion of the saw 22 having the cutting guide 28 attached according to one embodiment of the present invention. The cutting guide holder 38 retains the cutting guide 28 on the handle 36 of the saw 22.

Figure 11:
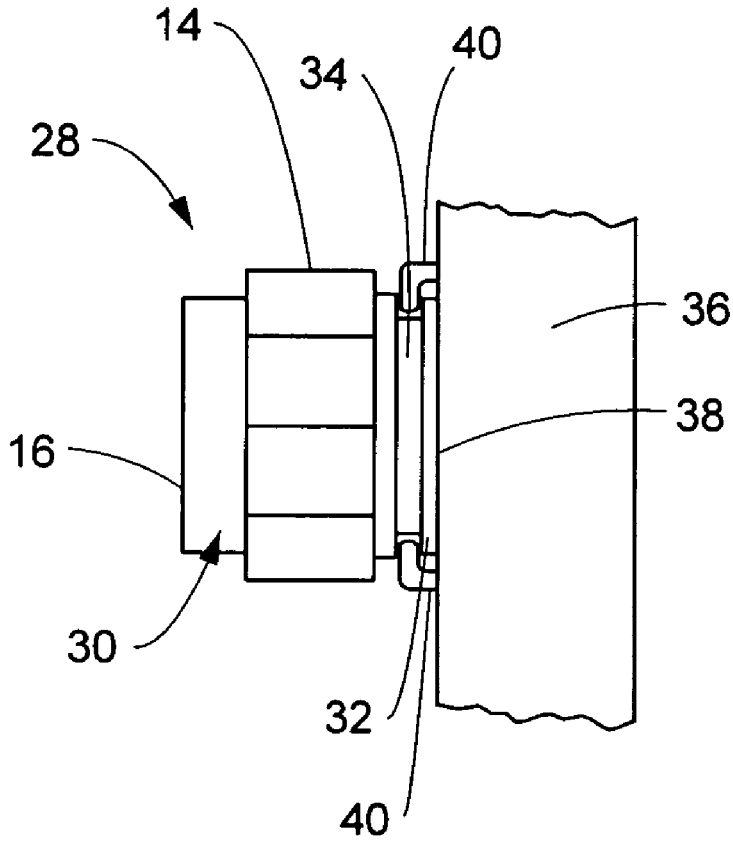
FIG. 11 is a diagram illustrating a rear view of a portion of the saw of FIG. 10 according to one embodiment of the present invention.

FIG. 11 is a diagram illustrating a rear view of a portion of the saw 22 of FIG. 10 according to one embodiment of the present invention. As can be seen in FIG. 11, the cutting guide 28 is retained in the cutting guide holder 38 on the handle 36 of the saw 22. The flexible raised portions 40 engage the groove 34 of the body portion 30 of the cutting guide 28 to securely retain the cutting guide 28 on the handle 36.

It can be understood that the cutting guides 10, 28 described herein may be used on any shape of material that is cut including cylindrical, rectangular, etc. Also, the cutting guides 10, 28 may be used to aid cutting of any type of material such as plastic, metal, wood, etc. The cutting guides 10, 28 may be employed to aid in starting a cut or may be employed during part of or an entirety of a cut.

It can be understood that the cutting guides 10, 28 may be cylindrically shaped as illustrated herein or may be any other shape such as rectangular, etc. Also, the cutting guides 10, 28 can be used in connection with any type of saw 22 including, for example, a hacksaw, a crosscut saw, a miter saw, a coping saw, a dovetail saw, a bow saw, a keyhole saw, etc.

The cutting guides 10, 28 may have any suitable dimensions. By way of example, the length of the cutting guides 10, 28 may be ¾" to 1½" in length. In various embodiments, the engagement portion 14 is removable from the body portion 12, 30 so that the engagement portion may be replaced if it becomes worn, damaged, etc.

While several embodiments of the invention have been described, it should be apparent, however, that various modifications, alterations and adaptations to those embodiments may occur to persons skilled in the art with the attainment of some or all of the advantages of the present invention. It is therefore intended to cover all such modifications, alterations and adaptations without departing from the scope and spirit of the present invention as defined by the appended claims.

What is claimed is:

1. A saw comprising:

a blade;

a handle attached to the blade, the handle including a cutting guide holder; and a cutting guide held by the cutting guide holder, the cutting guide comprising a body portion having a leading edge, a trailing edge, and an opening therethrough, the opening having a continuous perimeter defined by the body portion, and an engagement portion concentrically attached to the body portion, wherein the leading edge is adapted to guide the saw while a cut is being made in a material, and wherein the opening in the body portion is adapted to accept a portion of a user's hand, such that pressure can be applied by the user to a portion of the guide inside the opening to hold the engagement portion in contact with the material, wherein the engagement portion is constructed of one of rubber and plastic, and the body portion is cylindrical and is constructed of a hardened metal.

2. A saw comprising:

a blade;

a handle attached to the blade, the handle including a cutting guide holder; and a cutting guide held by the cutting guide holder, the cutting guide comprising a body portion having a leading edge, a trailing edge, and an opening therethrough, the opening having a continuous perimeter defined by the body portion, and an engagement portion concentrically attached to the body portion, wherein the leading edge is adapted to guide the saw while a cut is being made in a material, and wherein the opening in the body portion is adapted to accept a portion of a user's hand, such that pressure can be applied by the user to a portion of the guide inside the opening to hold the engagement portion in contact with the material, wherein the cutting guide holder includes a plurality of raised portions adapted to engage the body portion of the cutting guide to securely retain the cutting guide on the handle, and wherein the cutting guide further comprises a groove disposed in an outer surface of the body portion on the leading or trailing edge of the body portion, the groove being configured to fit in the cutting guide holder attached to a saw, wherein the engagement portion is constructed of one of rubber and plastic, and is shaped to conform to the material to be cut, the engagement portion being removably attached to the body portion, and wherein the body portion is cylindrical and is constructed of a hardened metal.

3. The saw of claim 2, wherein the saw is one of a hacksaw, a crosscut saw, a miter saw, a coping saw, a dovetail saw, a bow saw, and a keyhole saw.

4. The saw of claim 2, wherein the raised portions are constructed of one of plastic and metal.

5. The saw of claim 2, wherein the raised portions are attached to the handle on each lateral side of the handle.

6. The saw of claim 2, wherein the raised portions are molded into the handle.

7. The saw of claim 2, wherein the plurality of raised portions are adapted to engage the groove in the body portion of the cutting guide.

* * * * *